United States Patent [19]

Bergsma et al.

[11] Patent Number: 4,698,908

[45] Date of Patent: Oct. 13, 1987

[54] SHAVING APPLIANCE

[75] Inventors: Wijtse Bergsma, Drachten, Netherlands; Hans Labrijn, Tokyo, Japan; Olivier Sterk, Drachten, Netherlands

[73] Assignee: U.S. Philips Corporation, New York, N.Y.

[21] Appl. No.: 836,772

[22] Filed: Mar. 5, 1986

[30] Foreign Application Priority Data

Mar. 13, 1985 [NL] Netherlands ..... 8500707

[51] Int. Cl.[4] ..... B26B 19/00

[52] U.S. Cl. ..... 30/43.6; 30/43.2

[58] Field of Search ..... 30/43.2, 43.6, 346.51

[56] References Cited

U.S. PATENT DOCUMENTS 3,233,323 2/1966 Driessen ..... 30/43.2

FOREIGN PATENT DOCUMENTS 977156 12/1982 U.S.S.R. ..... 30/43.6

*Primary Examiner*—E. R. Kazenzke
*Assistant Examiner*—Michael D. Folkerts
*Attorney, Agent, or Firm*—Thomas A. Briody; William J. Streeter; Rolf E. Schneider

[57] ABSTRACT

A shaving apparatus comprises a housing having a top surface, and a holder together with a retaining element provided with three triangularly arranged cutting units. Provision is made for engaging the retaining element with the holder with the cutting units therebetween to form a unitary body detachable from the top surface of the housing. Three stepped recesses are arranged 120° apart in the peripheral wall of the retaining element, each recess having two steps. Three stops are arranged 120° apart on the top surface of the housing. The holder body can be mounted on the housing in three positions, the stops on the housing engaging one of the two steps in the retaining element recesses in each of two of such positions and engaging the peripheral wall of the retaining element in the remaining position, the axial distance between the retaining element and the holder thereby being varied.

2 Claims, 3 Drawing Figures

SHAVING APPLIANCE

This invention relates to a shaving apparatus or appliance comprising a housing provided with a detachable holder for three cutting units, each of which, includes an external cutting element provided with hair-catching openings or hair-entry apertures and an internal cutting element rotatably drivable relative to such external cutting element, the housing containing a drive mechanism which, by means of axially resilient drive spindles can be coupled with the respective internal cutting elements the holder containing an adjustable retaining element for the cutting units.

A shaving appliance of this kind is known for example from U.S. Pat. No. 3,233,323. In this known embodiment the retaining element forms a stop by means of which the distance in the axial direction over which the cutting units can be pressed inwards is adjustable. The displacement of the retaining element is effected by means of a relatively complicated and therefore costly mechanism including an operating element which is accessible only from the outside.

The object of the present invention is to provide a simple solution, which is therefore easy to manufacture, and is characterized by the fact that the holder can be placed in three different positions on the housing with respectively three different places of contact between the retaining element and the housing, so that the axial distance between the retaining element and the holder is variable.

The invention will now be explained in connection with the accompanying drawings, in which.

FIG. 3 gives a schematic outline of the three different positions of the retaining element relative to the housing.

Figure 1:
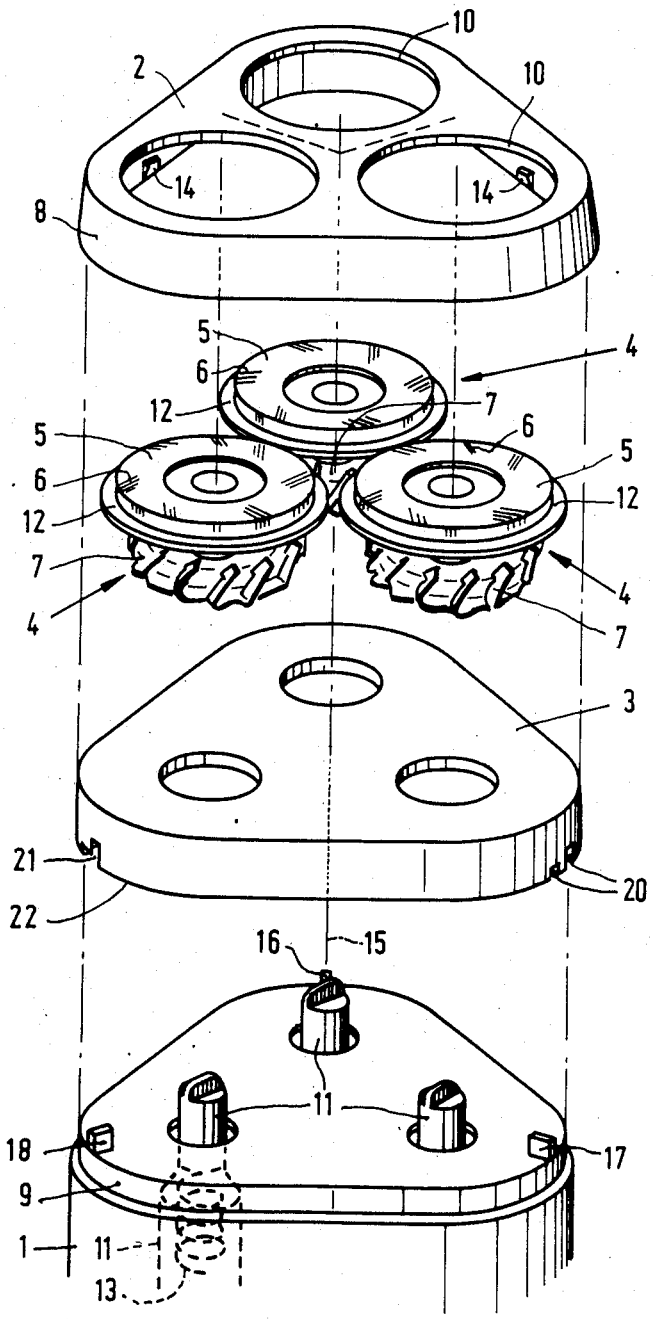
FIG. 1 shows in perspective an exploded view of a shaving appliance in accordance with the invention.
Figure 2:
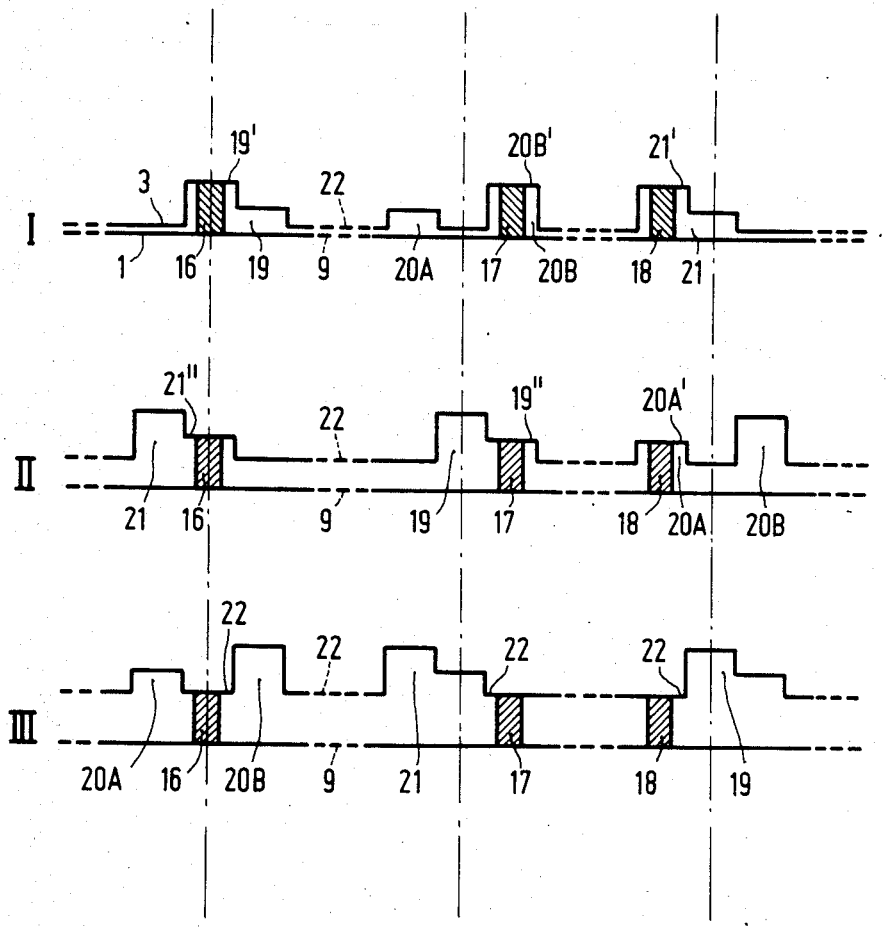
FIG. 2 is an assembled elevational view, partly in cross section, of the shaving appliance, taken along the line II—II of FIG. 1.

The shaving appliance as represented in FIG. 1 comprises a housing 1, a holder 2 and a retaining element 3 provided with three cutting units 4 arranged triangularly. Each cutting unit 4 comprises an external cutting element 5 with hair-catching openings 6 and an internal cutting element 7 which is driven with a rotating movement relative to the external cutting element. When the appliance is fully assembled, the edge 8 of the holder 2 fits against the indented part 9 of the housing 1. In this situation the cutting units 4 lie in the corresponding openings of the holder and the drive spindles 11 engage the corresponding internal cutting elements 7. Via these drive spindles 11 the cutting units 4 are coupled in the known way with an electric motor, not shown, contained in the housing 1. The cutting elements 5 each have a flanged edge 12 whose diameter is greater than of the openings 10, so that the cutting units in the assembled state of the appliance are enclosed between the holder and the retaining element. The drive spindles are respectively provided with spring elements 13 and can be pressed in against the action of these spring elements in the axial direction. In the unloaded state these spring elements 13 ensure that the external cutting elements 5 are kept pressed by means of the respective flanged edges 12 against the holder 2 by the drive spindles 11 via the internal cutting elements 7. Due to the forces produced during shaving, the cutting units 4 can be pressed in against the action of the spring elements 13 until they rest against the retaining element 3. The distance over which the cutting units 4 can be pressed in can be varied by varying in the axial direction the position of the retaining element 3 in the holder 2.

The holder 2, the retaining element 3 and the cutting units 4 form a unit any body which can be removed from the housing 1. In the assembled state the retaining element 3 possesses relative to the holder 2 a certain freedom of movement in the axial direction, which is limited by two or more projections or stops 14 on the inside of the holder 2. The stops 14 engage the retaining element 3 and thereby prevent the retaining element 3 and the cutting units 4 from falling out of the holder when the holder is removed from the housing 1.

The retaining element 3 and the holder 2 are constructed in such a way that the retaining element fits in the holder 2 in only one way. The combination of holder 2, retaining element 3 and cutting units 4 can, however, be mounted in three different positions on the housing 1 by rotation around an imaginary central axis 15. In each position the retaining element and the housing have different places of contact. Consequently, the axial distance between the retaining element 3 and the housing 1, and hence between the retaining element and the holder 2, ca be varied. These places of contact are formed by the stops 16, 17 and 18 on the top surface of the housing 1 and the sides of the recesses 19, 20 and 21 cut at the corresponding places in the peripheral wall 22 of the retaining element 3. The recess 20 consists of two parts, shown as 20A and 20B in FIG. 3.

FIG. 3 shows a schematic development in a flat plane of the wall 22 of the retaining element 3 and the part 9 of the housing 1. The three positions are indicated by I, II, III. In position I the stops 16, 17 and 18 rest respectively against the parts 19', 20B' and 21' of the wall 22. Since these parts of the wall define the deepest parts of the recesses 19, 20 and 21, in this position the retaining element 3, seen in the axial direction, lies closest to the housing 1. By removing the combination of holder 2, retaining element 3 and cutting units 4 from the housing and turning it 120°, position II is obtained. In this position the stops 16, 17 and 18 lie respectively against the parts 21'', 19'' and 20A' of the wall 22 which define the parts of the recesses 19, 20 and 21 that lie less deep than the previous parts. Finally, by a further rotation of 120°, a third position III is reached where the stops 16, 17 and 18 rest against the wall 22 of the retaining element 3. In the three positions the retaining element, viewed in the axial direction, lies at different distances from the housing 1, and so too therefore does the holder 2. In this way a simple construction is obtained with which it is possible to vary the axial distance over which the cutting units can be pressed inwards.

What is claimed is:

1. A shaving apparatus comprising a housing having a top surface; a holder and a retaining element provided with three triangularly arranged cutting units; means to engage the retaining element with the holder with the cutting units therebetween to form a unitary body detachable from the top surface of the housing; three stepped recesses arranged 120° apart in the peripheral wall of the retaining element, each recess having two steps; and three stops arranged 120° apart on the top surface of the housing; whereby the holder body can be mounted on the housing in three positions, the stops on the housing engaging one of the two steps in the retaining element recesses in each of two of such positions and engaging the peripheral wall of the retaining element in the remaining position, the axial distance between the retaining element and the holder thereby being varied.

2. A shaving apparatus according to claim 1, in which the engaging means comprises a plurality of inwardly directed projections on the holder for engaging the retaining element.

* * * * *